United States Patent [19]

Landis

[11] Patent Number: 4,470,328

[45] Date of Patent: Sep. 11, 1984

[54] SPECIAL TOOL

[75] Inventor: Alfred R. Landis, Stone Mountain, Ga.

[73] Assignee: Kearney-National Inc., Atlanta, Ga.

[21] Appl. No.: 469,208

[22] Filed: Feb. 24, 1983

[51] Int. Cl.[3] ..... B25B 13/00

[52] U.S. Cl. ..... 81/53.1; 81/57.29

[58] Field of Search ..... 81/53.1, 57.29; 294/20, 294/21

[56] References Cited

U.S. PATENT DOCUMENTS

| | | | |
|---|---|---|---|
| 1,199,823 | 10/1916 | Sadtler | 81/57.29 |
| 2,701,490 | 2/1955 | Griparis | 81/57.29 |
| 3,111,049 | 11/1963 | Brehmer | 81/53.1 |
| 3,733,936 | 5/1973 | Flynn | 81/57.29 |
| 4,242,930 | 1/1981 | Myers et al. | 81/53.1 |

*Primary Examiner*—James L. Jones, Jr.

*Attorney, Agent, or Firm*—Rodgers & Rodgers

[57] ABSTRACT

A tool for use in conjunction with energized high voltage electric circuits and which includes a housing structure having a pair of angularly related intersecting passages, a pair of bevelled pinions rotatably mounted respectively in said passages and arranged to cooperate with each other, a stem portion of the driven one of said pinions being connected with a coupling element, an elongated tubular element formed of insulating material and having one end thereof secured to the housing structure in coaxial relation to the one of said passages in which a driving pinion is mounted, and an elongated tubular drive shaft rotatably mounted within said elongated tubular element and having its inner end secured to the stem of the driving one of said pinions and having its outer end projecting outwardly of the outer end of said tubular element.

1 Claim, 5 Drawing Figures

SPECIAL TOOL

TECHNICAL FIELD

This invention relates to maintenance and repair of high voltage electric circuits disposed within metal housing structures.

BACKGROUND ART

Tools for use in conjunction with energized high voltage electric circuit components mounted within metal housing units are known but such devices are not specially adapted for affording workable access to parts which are difficult to reach because of their orientation or some other reason.

DISCLOSURE OF THE INVENTION

According to this invention in one form, a tool comprises a housing structure which includes a pair of intersecting angularly related passages, a pair of bevelled pinions mounted respectively in said passages, a coupling element secured to the stem portion of a driven one of said pinions, an elongated tubular element formed of insulating material and secured to said housing structure in coaxial relation with the one of said passages in which a driving one of said pinions is mounted together with an elongated tubular drive shaft formed of insulating material and disposed within said tubular element and interconnected with said driving pinion, the outer end of said insulating tubular drive shaft being arranged to project outwardly from the outer end of said elongated tubular element.

BEST MODE OF CARRYING OUT THE INVENTION

Figures 1, 2:
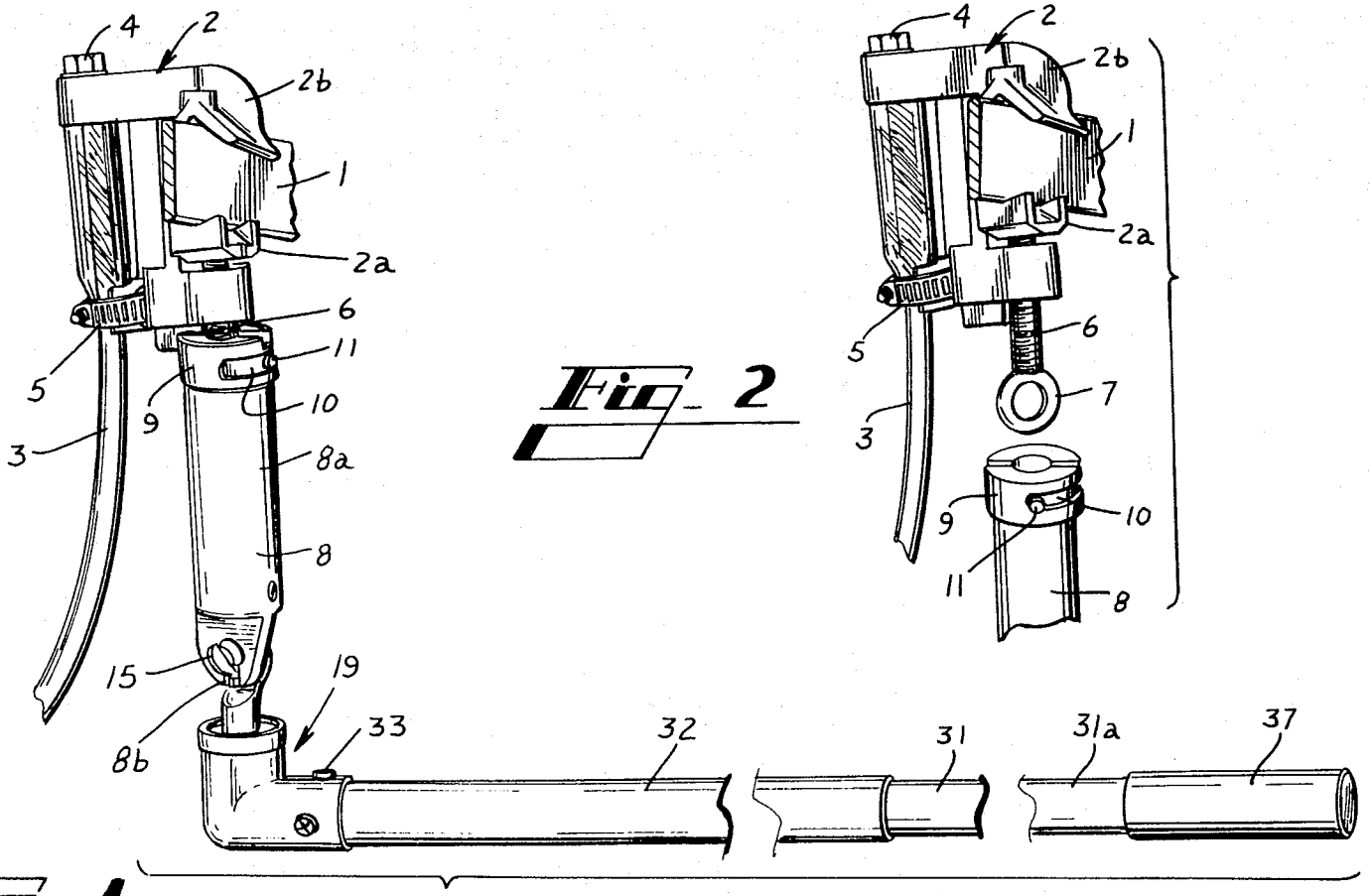
FIG. 1 is an overall view of a tool constructed according to this invention shown in operative relation with associated components which are operated by the driving tool.
FIG. 2 is a view similar to FIG. 1 but which shows associated components in disconnected relation to each other.

In the drawings the numeral 1 designates a high voltage electric bus and the numeral 2 generally designates a C-clamp to which a grounding conductor 3 is electrically connected by the nut 4. Conductor 3 is mechanically secured to C-clamp 2 by adjustable collar 5.

In order to ground bus bar 1, the movable jaw 2*a* of the C-clamp 2 is driven upwardly so as to clamp the bus 1 between the jaw 2*a* and the fixed jaw 2*b*. Such motiion is conventional and is imparted by the rotatable threaded element 6 the lower end of which is constructed with an eyelet 7. Thus rotation of element 6 in one direction drives the jaw 2*a* upwardly into clamping relation with the bus 1 whereas rotation of the threaded element 6 in the opposite direction causes the jaw 2*a* to move downwardly and out of engagement with the lower edge of bus bar 1.

The C-clamp 2, the bus 1 as well as grounding conductor 3 are of conventional construction.

Connecting element 8 includes a hollow cylindrical sleeve 8*a* together with a collar 9 having a slot 10 formed about a portion of its periphery. A radially extending stud 11 is secured to the sleeve 8*a* and rides in the slot 10. Collar 9 is rotatable about the cylindrical sleeve 8*a*.

Figure 5:
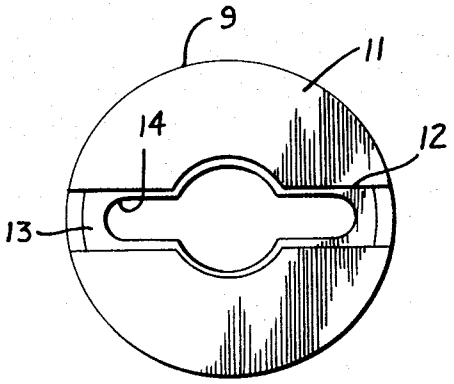
FIG. 5 is a view similar to FIG. 4 but which shows the connecting tool with its components arranged in unlocked condition whereby the connecting element may be disconnected from the eyelet of the C-clamp.
Figure 4:
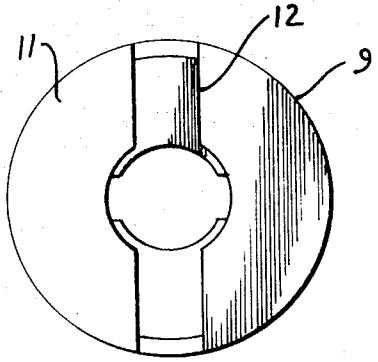
FIG. 4 is a top view of a connecting element rotated by the tool of this invention and which shows the parts of the connecting element in their positions of interlocking relationship with the eyelet of a C-clamp such as is shown in FIGS. 1 and 2.
Figure 3:
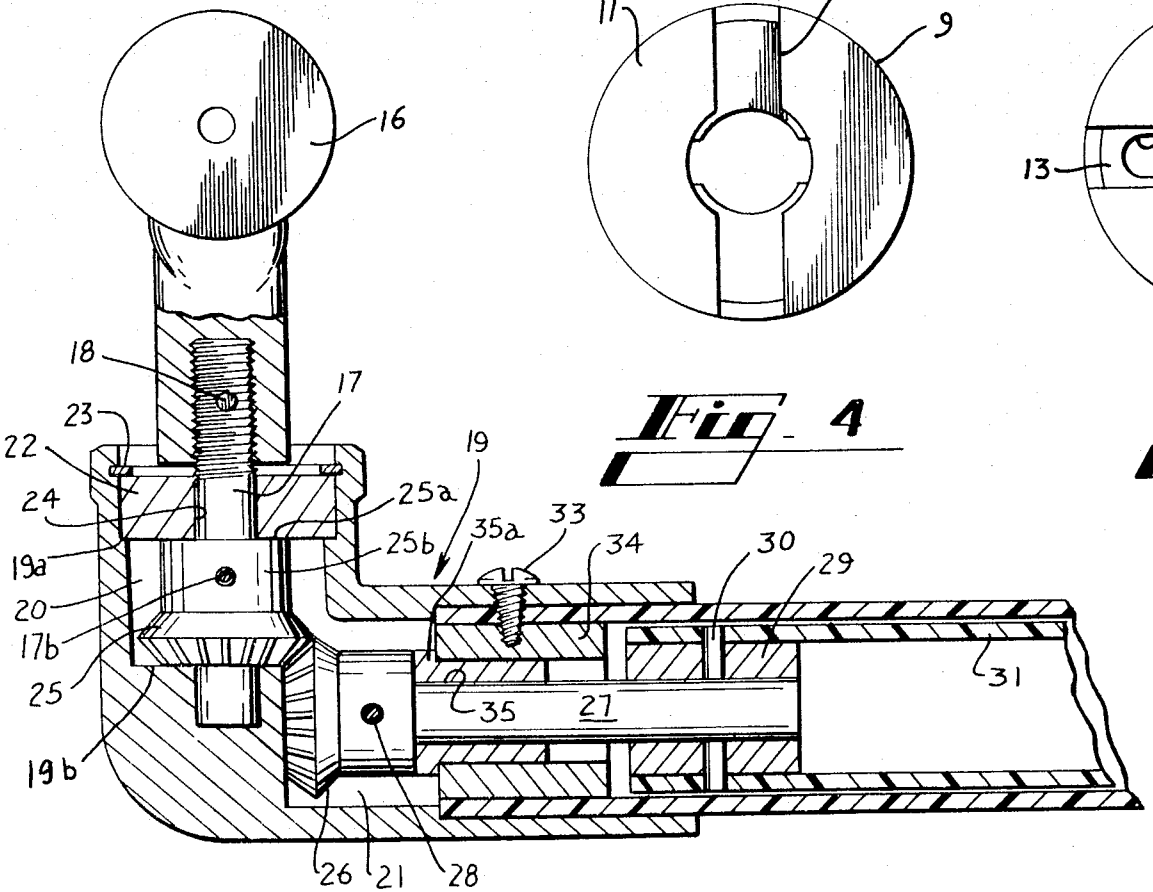
FIG. 3 is an enlarged cross sectional view of the tool formed according to this invention.

FIG. 4 shows the collar 9 in its locked position relative to eyelet 7 whereas FIG. 5 shows collar 9 in its unlocked condition. As is apparent from both FIGS. 4 and 5 the upper end of collar 9 is closed by structure 11 in which a transverse slot generally indicated by the numeral 12 is formed. The upper end of structure 8 is closed by means of closure structure 13 in which a slot 14 is formed.

Thus with the eyelet 7 inserted through the structure of FIG. 5, the collar 9 is then rotated to the position shown in FIG. 4. The eyelet 7 is then locked against rotation relative to the structure 8 due to engagement with the slot 14 formed in the end portion 13 of the structure 8.

By the structure shown in FIGS. 4 and 5 the connector 8 may be disjointably connected with the eyelet 7.

Connector 8 is also provided with a slot 8*b* at its lower end which is arranged to receive the threaded locking screw 15 which is threadedly mounted on coupling 16 which is threadedly mounted on the stem 17 and which is secured thereto by means of pin 18.

Housing structure generally indicated by the numeral 19 includes a pair of intersecting angularly related passages generally designated 20 and 21. A bushing 22 is mounted within passage 20 and secured therein by a washer 23 and shoulder 19*a* of housing 19 and is provided with an aperture 24 which rotatably receives the stem 17 of driven bevelled pinion 25. End 25*a* of pinion 25 engages the bushing 22 while shoulder 19*b* of housing 19 engages pinion 25. Set screw 17*b* secures stem 17 to pinion 25 by engaging a key (not shown) which is conventional and which rests in complementary slots in stem 17 and pinion 25. Cooperating with driven pinion 25 is driving bevelled pinion 26 mounted in passage 21. Driving pinion 26 is connected to its stem 27 by means of a set screw 28 and via conventional key and associated slots (not shown). Stem 27 is secured within sleeve 29 by means of transversely extending pin 30 which also interconnects sleeve 29 and driving pin 27 with drive shaft 31 formed of insulating material and which is arranged with its outer end 31*a* projecting outwardly of the outer end of tubular element 32 formed of insulating material and secured by screws 33 at its inner end in coaxial relation with passage 21 formed in housing structure 19. A bushing 34 is secured by means of screws 33 about a bushing 35 on one end of which a flange 35*a* is formed. Thus bushing means 34 and 35 constitute low friction means whereby easy rotation of driving pin 27 is facilitated and whereby pinion 26 is secured against outward axial movement relative to housing 19. The outer end of 31*a* of driving element 31 includes a hand gripping device 37.

Thus by means of the invention rotary motion may be imparted to parts to which access is difficult due to the fact that rotary motion can be transmitted by driving means which is angularly disposed with respect to driven means and by structure which is safe for the operator due to the fact that the driving element and its associated tubular housing element are of substantial length.

INDUSTRIAL APPLICABILITY

A tool formed according to this invention is well adapted for use by maintenance and repair personnel who are required to perform their functions while high voltage circuits are energized. While the invention has been illustrated in conjunction with a C-clamp used to connect a grounding conductor with a bus bar, it is obvious that the invention is not limited to this particular use and that it has other applications as well. Also the angular relation between the passages 20 and 21 and the axes of their associated pinions need not be 90° as shown but may be some other angle if desired.

I claim:

1. A tool for use in conjunction with energized high voltage electric circuits, said tool comprising an elongated tubular element formed of insulating material, a housing structure having a pair of angularly related intersecting passages one of which is secured to and coaxial with one end of said elongated tubular element, an elongated tubular drive shaft formed of insulating material and rotatably mounted within said tubular element and provided with a hand driven end portion projecting out of said tubular element at the end thereof remote from said housing structure, a bevelled driving pinion rotatably mounted in said one passage and having a stem portion secured to the adjacent end of said drive shaft, a bevelled driven pinion rotatably mounted in the other of said passages in cooperating relation with said driving pinion and having a stem portion arranged to project out of said other passage, a coupling element secured to and rotatable with said stem portion of said driven shaft, low friction bushing means including a pair of telescopically related bushings the outer one of which is fixedly secured within said one passage and the other of which is disposed about the stem of said driving pinion and a sleeve fixedly mounted within said drive shaft at the end thereof which is adjacent said one passage, said sleeve being rotatable with said drive shaft, said stem portion of said driving pinion being fixedly mounted within said sleeve and being rotatable therewith.

* * * * *